US007108206B2

(12) United States Patent
Yacoub et al.

(10) Patent No.: US 7,108,206 B2
(45) Date of Patent: Sep. 19, 2006

(54) VALVE ASSEMBLY AND FUEL INJECTOR USING SAME

(75) Inventors: Victor I. Yacoub, Flanagan, IL (US); Gene R. Slinkard, Pontiac, IL (US); Charles D. Ellenbecker, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 324 days.

(21) Appl. No.: 10/309,791

(22) Filed: Dec. 4, 2002

(65) Prior Publication Data

US 2004/0124272 A1 Jul. 1, 2004

(51) Int. Cl.

| | |
|---|---|
| ***B05B 1/00*** | (2006.01) |
| *B05B 1/30* | (2006.01) |
| *B05B 7/30* | (2006.01) |
| *F02M 51/00* | (2006.01) |
| *F02M 14/60* | (2006.01) |

(52) U.S. Cl. ..... 239/600; 239/585.1; 239/353; 239/585.4; 239/533.2; 239/533.11; 285/353; 285/354; 285/337; 137/625.5

(58) Field of Classification Search ..... 239/533.2, 239/533.11, 600, 251, 5, 585.1, 585.4; 285/353, 285/354, 337; 137/625.5, 315.09, 315.11
See application file for complete search history.

(56) References Cited

U.S. PATENT DOCUMENTS

| | | | | |
|---|---|---|---|---|
| 4,346,846 | A * | 8/1982 | Eblen et al. | 239/533.3 |
| 4,941,613 | A * | 7/1990 | Hardy et al. | 239/124 |
| 4,946,103 | A * | 8/1990 | Ganser | 239/88 |
| 5,201,295 | A * | 4/1993 | Kimberley et al. | 123/467 |
| 5,381,965 | A * | 1/1995 | Chabon et al. | 239/585.1 |
| 5,669,355 | A * | 9/1997 | Gibson et al. | 123/446 |
| 5,692,723 | A * | 12/1997 | Baxter et al. | 251/129.21 |
| 5,943,995 | A * | 8/1999 | Niwa et al. | 123/470 |
| 5,961,052 | A * | 10/1999 | Coldren et al. | 239/585.1 |
| 6,065,692 | A * | 5/2000 | Brinn, Jr. | 239/533.12 |
| 6,283,390 | B1 * | 9/2001 | Brendle et al. | 239/533.2 |
| 6,354,271 | B1 | 3/2002 | Satapathy | |
| 6,363,913 | B1 | 4/2002 | Milam et al. | |
| 6,375,098 | B1 * | 4/2002 | Fuseya et al. | 239/533.11 |
| 6,425,532 | B1 * | 7/2002 | Popp | 239/132.5 |

(Continued)

FOREIGN PATENT DOCUMENTS

JP 408100737 A * 4/1996

OTHER PUBLICATIONS

United States Patent Application Publication, Injection Vavle with Single Disc Turbulence Generation, by William A. Peterson Jr.; Filing Date Jun. 3, 2002, all.*

*Primary Examiner*—David A. Scherbel
*Assistant Examiner*—James S. Hogan
(74) *Attorney, Agent, or Firm*—Liell & McNeil

(57) ABSTRACT

The present invention broadly applies to any fluid valve made up of a plurality of body components that create sealing lands where the body components are clamped together. The invention is further applicable to any such valves in which pressure differentials within the valve can cause fluid leakage in the region of these sealing lands. Fluid leakage is reduced by locating at least some of these sealing lands within a hollow clamp that holds the valve body components together. This clamping strategy that locates the clamping load where it is needed most is applicable to a wide variety of valves, but is particularly applicable to pressure control valves used in fuel injection systems that experience extremely high pressure differentials during their usage.

18 Claims, 3 Drawing Sheets

U.S. PATENT DOCUMENTS 6,530,363 B1 * 3/2003 Blass et al. ..... 123/446
6,695,233 B1 * 2/2004 Sekine et al. ..... 239/585.1
6,705,551 B1 * 3/2004 Kienzler et al. ..... 239/533.3
6,811,102 B1 * 11/2004 Krause et al. ..... 239/533.2
2002/0130193 A1 * 9/2002 Peterson, Jr. ..... 239/5

* cited by examiner

VALVE ASSEMBLY AND FUEL INJECTOR USING SAME

TECHNICAL FIELD

The present invention relates generally to valve assemblies that are subject to potential leakage due to relatively high pressure differentials, and more particularly to a hollow clamp for holding a plurality of valve body components together.

BACKGROUND

Electro-hydraulic actuators, such as those used in conjunction with fuel injectors having a direct control needle valve, rely upon relatively small and fast valves in order to control fuel injection characteristics. In one class of fuel injection systems, a direct control needle valve opens and closes the nozzle outlet of the fuel injector. The direct control needle valve is controlled hydraulically via a relatively high speed needle control valve that has the ability to apply either low pressure or high pressure to a closing hydraulic surface associated with the direct control needle valve. One such direct control needle valve and accompanying needle control valve is disclosed in co-owned U.S. Pat. No. 5,669,355 to Gibson et al. That reference teaches a fuel injector that includes a needle control valve with the ability to apply high pressure or low pressure oil to a closing hydraulic surface of a direct control needle valve. When high pressure is applied to the closing hydraulic surface, the needle valve stays in, or moves toward, its closed position to end the spray of fuel. When low pressure is applied to the closing hydraulic surface, and the fuel is at injection pressure levels, the needle valve will stay in, or move toward, its open position to allow fuel to spray out of the nozzle outlets of the fuel injector. In order to accomplish various goals, such as reducing undesirable emissions from an engine, engineers are constantly seeking ways of improving performance of direct control needle valves, especially by addressing problems associated with needle control valves.

One of the problems that could be addressed in improving a needle control valve is to reduce response time. This problem can then be broken down into seeking ways to reduce the valve member's travel distance, increasing the travel speed and/or acceleration of the valve member, decreasing the influence of fluid flow forces on valve member movement, and other issues known in the art. In addition, it is desirable to employ strategies that hasten the rate at which pressure changes can occur within the needle control chamber that applies the hydraulic force to the closing hydraulic surface of the needle valve member. These problems are further compounded by issues relating to an available space envelope for the valve, and maybe more importantly the ability to address all of these problems with a structure that allows for the valve to be mass produced with consistent behavior from one valve to another.

Still another problem that could be addressed relates to efficiency. For instance, reducing leakage through the valve can make a difference in the overall viability of a given valve. Leakage is potentially a problem since many valve assemblies include a valve body made up of several components that are attached or otherwise clamped together. For instance, a typical three way valve might include an upper seat component separated from a lower seat component by a valve lift spacer. These three components can be held together with four bolts distributed around the periphery of the valve body. While such a strategy can be successful, the areas needing the highest clamping loads are often located toward the center and well away from the periphery of the valve body. For instance, the valve assembly might have a centrally located valve member adjacent an annual sealing land defined by the contact area between the valve body components. Because these sealing lands can be subjected to relatively extremely high pressure differentials during an injection event, leakage through these sealing lands can be a concern. Therefore, the region around these sealing lands are in need of relatively high clamping forces in order to avoid leakage. Unfortunately, spacial constraints attributable to plumbing and other factors known in the art prevent, or at least inhibit, placement of clamping bolts closer to the areas where they are needed.

The present invention is directed to one or more of the problems set forth above.

SUMMARY OF THE INVENTION

In one aspect, a valve assembly comprises a valve body that includes a plurality of body components. A hollow clamp is clamped to the plurality of body components, and a valve member is at least partially positioned in the hollow clamp.

In another aspect, a fuel injector includes a needle control valve assembly with a plurality of body components clamped together with a hollow clamp. A needle control valve member is at least partially positioned in the hollow clamp.

In still another aspect, a method of reducing leakage in a valve assembly includes a step of clamping a plurality of valve body components together with a hollow clamp. A valve member is positioned at least partially within the hollow clamp. An annular sealing land of the plurality of valve body components is located within the hollow clamp.

DETAILED DESCRIPTION

Figure 1:
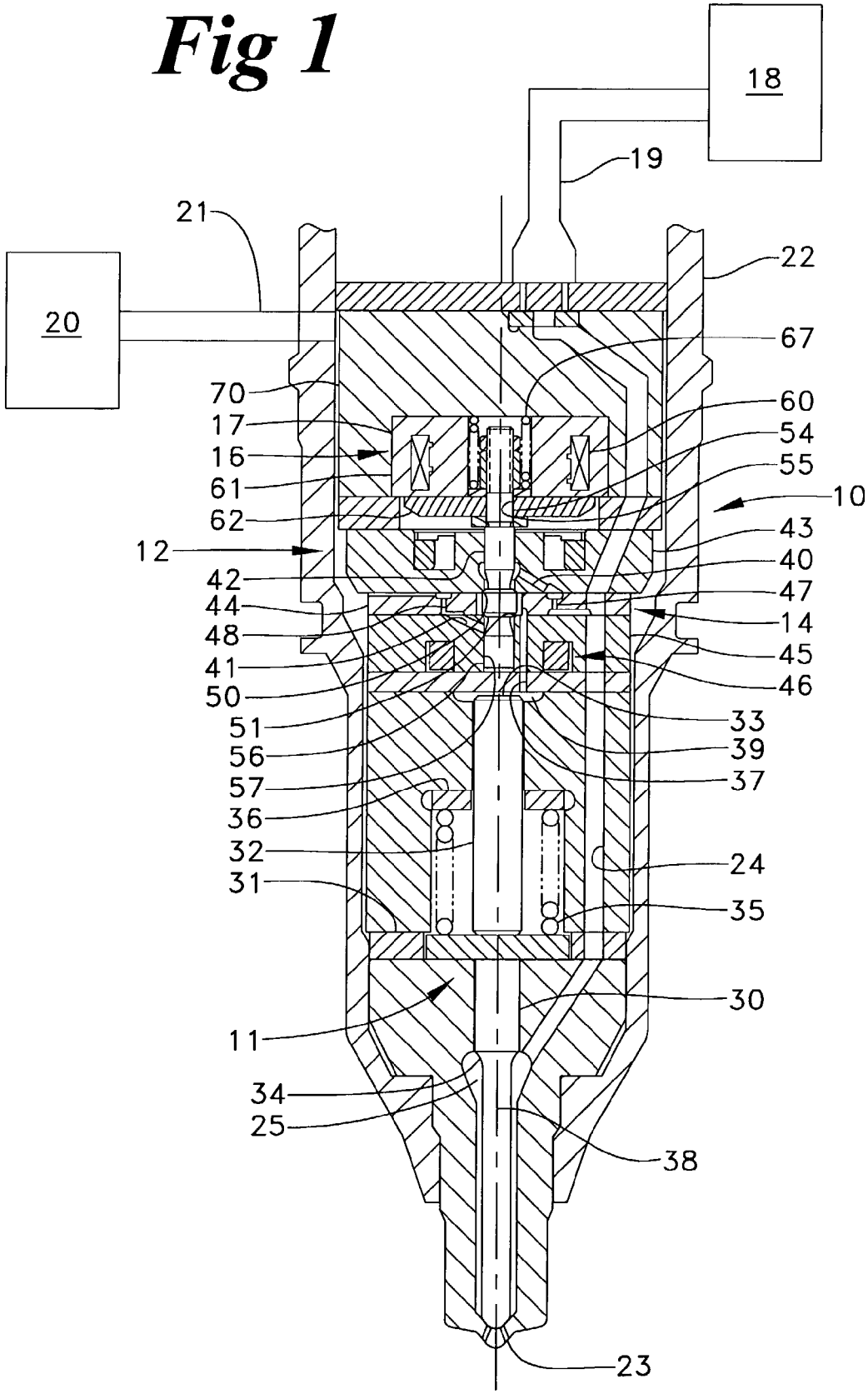
FIG. 1 is a sectioned side diagrammatic view of a fuel injector according to one aspect of the present invention.

Referring to FIG. 1, a fuel injector 10 includes a direct control needle valve 11 that is operably coupled to an electro-hydraulic actuator 12. Electro-hydraulic actuator 12 includes a needle control valve assembly 14 that is operably coupled to an electrical actuator 16. Fuel injector 10 is connected to a source of high pressure fuel 18 via a fuel supply line 19, and connected to a low pressure fuel reservoir 20 via a fuel transfer passage 21. Those skilled in the art will recognize that the source of high pressure fuel 18 can come from a common rail, a unit pump, a fuel pressurization chamber within a unit injector or any other means known in the art for pressurizing fuel to injection levels. In addition, the injector body 22 includes at least one nozzle outlet 23.

Within fuel injector 10, fuel arriving from high pressure fuel source 18 travels through an unobstructed nozzle supply passage 24 to arrive at a nozzle chamber 25, which is shown blocked from fluid communication with nozzle outlet 23 by a needle portion 30 of direct control needle valve 11. Needle portion 30 includes an opening hydraulic surface 34 exposed to fluid pressure in nozzle chamber 25. Direct control needle valve 11 is normally biased downward to its closed position, as shown, by the action of a biasing spring 35 acting on a lift spacer 31, which is in contact with a top surface of needle portion 30. Direct control needle valve 11 also includes a piston portion 32 with a closing hydraulic surface 33 exposed to fluid pressure in a needle control chamber 37. Opening hydraulic surface 34 is in opposition to closing hydraulic surface 33. When needle control valve assembly 14 is in a first position, needle control chamber 37 is fluidly connected to source of high pressure fuel 18 via a high pressure passage 40 that connects at one end into nozzle supply passage 24. When valve 14 is at its second position, needle control chamber 37 is fluidly connected to low pressure reservoir 20 via a low pressure passage 41. Valve assembly 14 is moved between its first position and its second position by energizing and deenergizing electrical actuator 16. When high pressure exists in needle control chamber 37, direct control needle valve 11 will stay in, or move toward, its downward closed position, as shown. When needle control chamber 37 is connected to low pressure, direct control needle valve 11 will lift to its upward open position if fuel pressure acting on opening hydraulic surface 34 is above a valve opening pressure, which is preferably determined by a biaser, such as the preload of biasing spring 35. In practice, the valve opening pressure of direct control needle valve 11 is adjusted by choosing a VOP spacer 36 of an appropriate thickness. In addition, the lift distance of direct control needle valve 11 is controlled by choosing an appropriate thickness for lift spacer 31. Those skilled in the art will appreciate that in the disclosed embodiment, needle control chamber 37 is a closed volume. In other potential versions of the present invention, the needle control valve assembly is a two way valve positioned in a drain from the needle control chamber. In still another needle control valve assembly, a two way valve is positioned on the high pressure side of a needle control chamber that is always fluidly connected to drain. In either of these two alternatives, flow restrictions are sometimes used to produce the desired pressure results in conjunction with the needle control valve assembly. In any version, relatively high pressure differentials can exist within the valve separating fuel at injection pressure levels from relatively low pressure fuel train or vent passages.

Three way needle control valve assembly 14 is preferably positioned in close proximity to piston portion 32 so that the volume of needle control chamber 37 is made relatively small. Those skilled in the art will appreciate that pressure changes in needle control chamber 37 can be hastened by reducing its volume. This issue is addressed by actuator 12 in at least two ways. First, three way valve 14 is positioned in close proximity to the closing hydraulic surface 33 of piston portion 32. In addition, needle control chamber 37 is preferably designed to be defined at least in part by volume reducing surface features. Although piston 32 could be located in a common body as lower seat component 45, it is preferably separated from the same by a relatively thin separator and housed in its own piston guide body, as shown in FIG. 1. Thus, those skilled in the art will recognize that some measurable amount of improved performance can be achieved by paying attention to what surface features that define needle control chamber can be changed in order to reduce the volume of needle control chamber 37 without otherwise undermining performance. In most instance, it will be desirable to make any flow areas associated with needle control chamber 37 less restrictive than the flow areas associated with high pressure passage 40, low pressure passage 41, or the flow areas across seats 50 and 51. When valve member 42 is in contact with lower seat 51, as shown, needle control chamber 37 is fluidly connected across high pressure seat 50 to nozzle supply passage 24 via high pressure passage 40. When valve member 42 is lifted upward into contact with high pressure seat 50, needle control chamber 37 is fluidly connected to a low pressure area that surrounds actuator 12 across low pressure seat 51 via low pressure passage 41. Thus, valve member 42 can be thought of as being trapped between upper seat 50 and lower seat 51. Seats 50 and 51 can also be referred to as first and second seats, or vice versa. In order to reduce the influence of hydraulic forces on opposite ends of valve member 42, a vent passage vents the armature cavity to low pressure, and another vent passage connects to the vented chamber underneath valve member 42.

Valve member 42 is preferably operably coupled in a known manner to the moveable portion of an electrical actuator. In the illustrated embodiment, valve member 42 is attached to an armature 62 via a nut that is threaded onto one end of valve member 42. In particular, an armature washer rests upon an annular shoulder, upon which armature 62 is supported. Next, a nut washer is placed in contact with the other side of armature 62 followed by a spacer, against which the nut bears. Armature 62 and hence valve member 42 are biased downward to close low pressure seat 51 by a suitable biaser, such as biasing spring 67. Those skilled in the art will appreciate that a hydraulically biaser could be an alternative to the mechanical biaser shown. In addition, while electrical actuator 16 has been shown as a solenoid, those skilled in the art will appreciate that any other suitable electrical actuator, such as a piezo (disks and/or a bender) or a voice coil could be substituted in its place. A stator assembly 17 includes a stator 61, a coil 60 and preferably includes a female/male electrical socket connector (not shown). Stator assembly 17 is preferably positioned within a carrier assembly 70 such that their respective bottom surfaces lie in a common plane. By doing so, a solenoid spacer having an appropriate thickness can be chosen to provide a desired air gap between armature 62 and stator 61. Thus, the solenoid spacer is preferably a categorized part that comes in variety of slightly different thicknesses that allow different valves to perform similarly by choosing an appropriate thickness to provide uniformity in the armature air gap from one actuator to another.

In order to aid in concentrically aligning upper seat 50 with lower seat 51 along common centerline 38, valve member 42 includes an upper guide portion 54 with a close diametrical clearance (i.e. a guide clearance) with an upper guide bore 55 located in an upper seat component 43. In addition, valve member 42 also preferably includes a lower guide portion 56 having a relatively close diametrical clearance with a lower guide bore 57 located in a lower seat component 45. Thus, these guide regions tend to aid in concentrically aligning upper and lower seats 50 and 51 during the assembly of three way valve 15 (FIG. 5) as well as substantially fluidly isolating needle control chamber 37 from the vented chamber below valve member 42 and/or the armature cavity, regardless of the position of valve member 42. Because it is difficult to be certain, before assembly, the depth into seats 50 and 51 that valve member 42 will penetrate before coming in contact in closing that particular seat, three way valve 15 preferably employs a valve lift spacer 44 that is also a category part, and is preferably categorized in a plurality of different thickness groups. Thus, the distance that valve member 42 travels between upper and lower seats 50 and 51 is adjustable by choosing an appropriate thickness for valve lift spacer 44.

In order to reduce the influence of fluid flow forces on the movement of valve member 42, high pressure passage 40 and low pressure passage 41 preferably include flow restrictions that are restrictive relative to a flow area across respective seats 50 and 51. While these flow restrictions could be located in upper seat component 43 and/or lower seat component 45, they are preferably located in valve lift spacer 44. In particular, the flow characteristics through high pressure passage 40 can be relatively tightly controlled by including a cylindrical segment 47 having a predetermined length and flow area. Furthermore, cylindrical segment 47 is relatively restrictive to flow relative to that across upper seat 50. Those skilled in the art will appreciate that it is easier to control, and consistently machine, a flow characteristic via a cylindrical segment as opposed to attempting to consistently control a flow area between stationary seat component and moveable valve member 42. Likewise, low pressure passage 41 preferably includes a cylindrical segment 48 that is located in valve lift spacer 44. In order to differentiate the rate at which pressure changes can occur in needle control chamber 37, cylindrical segment 48 preferably has a different flow area relative to cylindrical segment 47. This feature is present in the illustrated example as a strategy by which the opening rate of the direct control needle valve is slowed relative to the closure rate of the same. In other words, when direct control needle valve 11 lifts toward its open position, fluid is displaced from needle control chamber 37 through the flow restriction defined by cylindrical segment 48. When direct control needle valve 11 is closed, high pressure fluid flows into needle control chamber 37 from high pressure passage 40 through the flow restriction defined by cylindrical segment 47. Since cylindrical segment 48 has a smaller flow area than cylindrical segment 47, in the illustrated embodiment, the opening rate of direct control needle valve 11 can be made slower than its closure rate, which is often desired.

Figure 2:
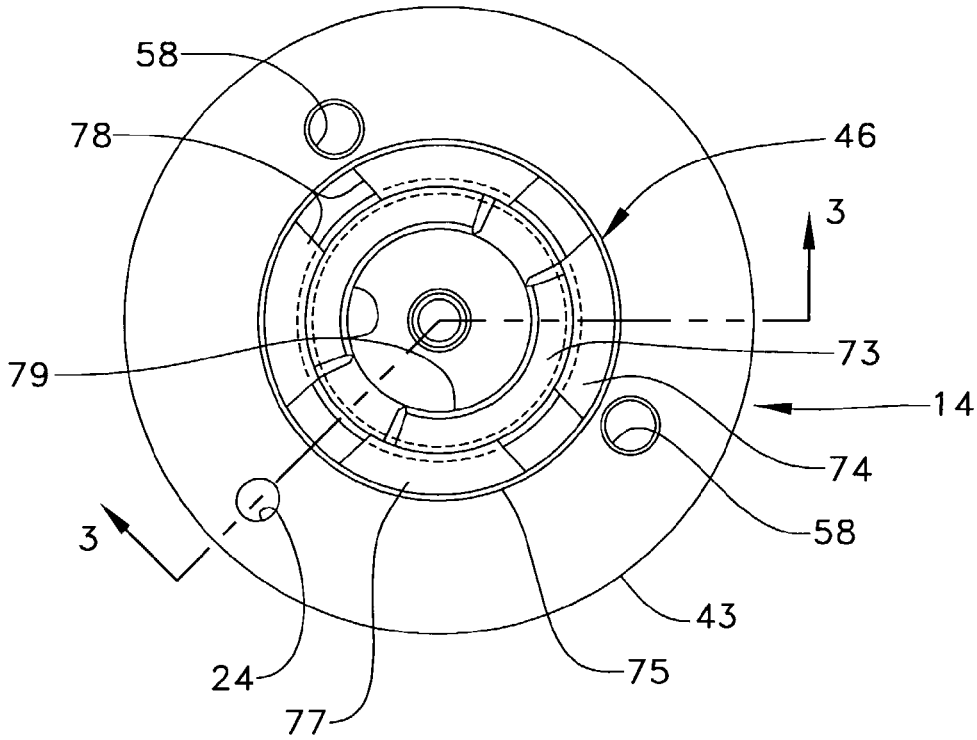
FIG. 2 is a top diagrammatic view of a needle control valve assembly from the fuel injector of FIG. 1.
Figure 3:
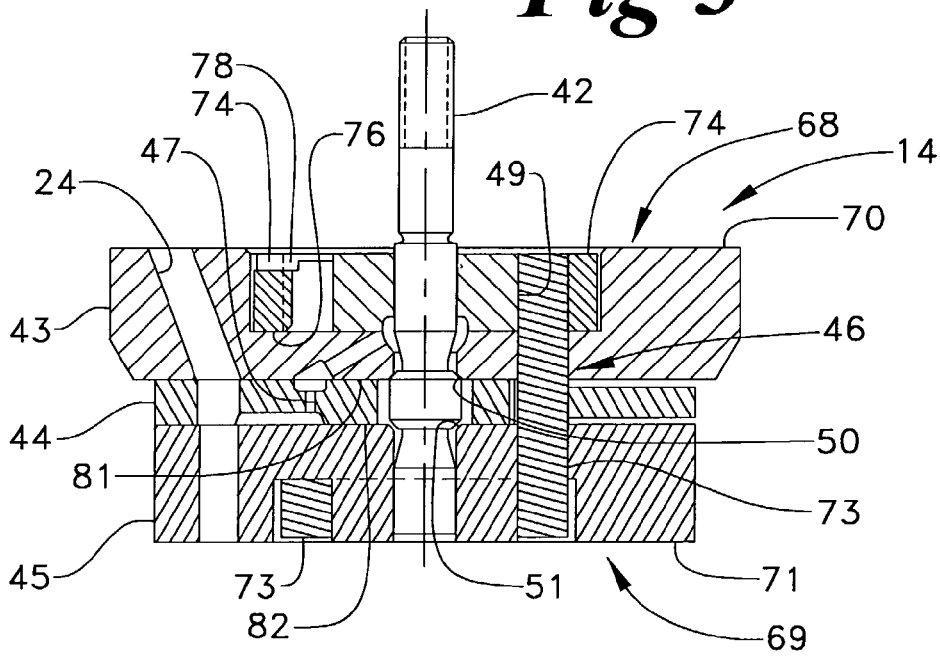
FIG. 3 is a sectioned side diagrammatic view of the valve assembly of FIG. 2 as viewed along section lines A—A.
Figure 4:
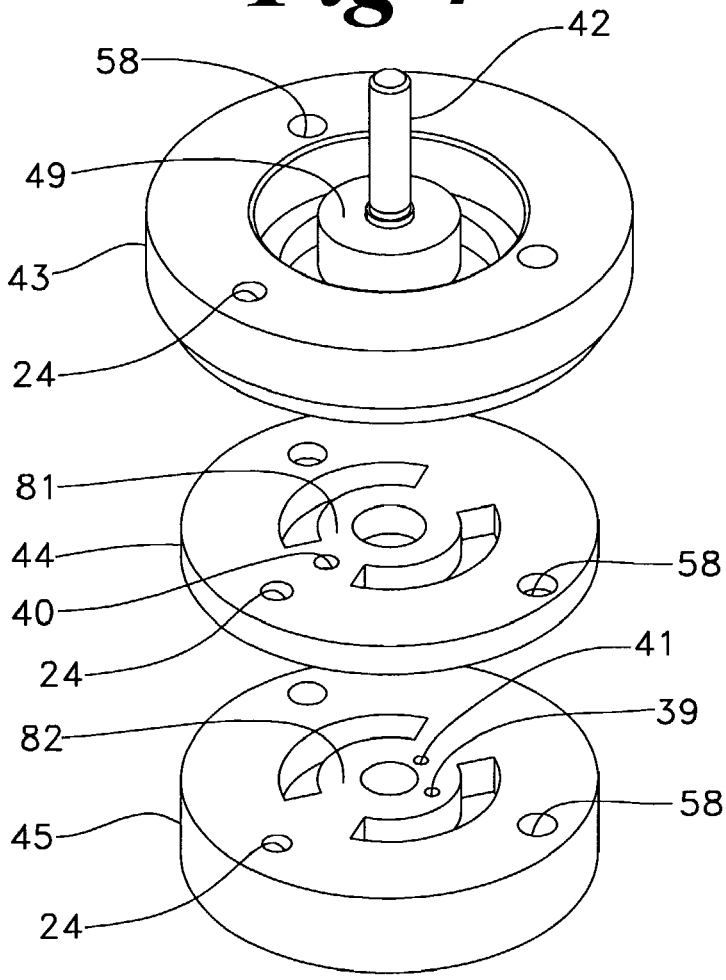
FIG. 4 is an exploded isometric view of the valve assembly of FIGS. 2 and 3.
Figure 5:
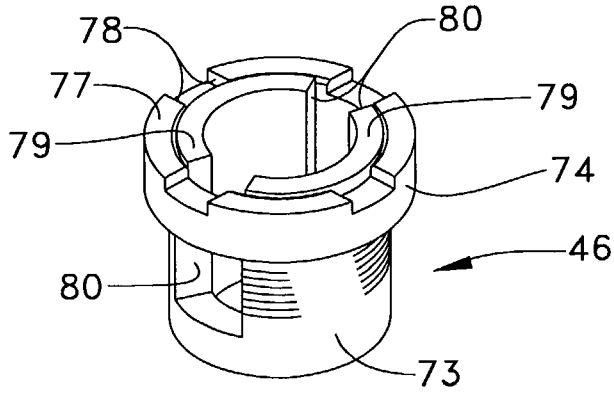
FIG. 5 is an isometric view of a hollow clamp according to an aspect of the present invention.

In order to accommodate for the possibility of a slight angular misalignment between the centerline of valve member 42 and the respective centerlines of upper and lower seats 50 and 51, valve member 42 preferably includes spherical valve surfaces, which have a common center. Those skilled in the art will appreciate that spherical valve surfaces 52 and 53 can contact and close valve seats 50 and 51 even in the event of some minor angular misalignment between valve member 42 and its respective seats. In order to insure that the respective passageways, such as nozzle supply passage 24, provide the proper fluid connection as shown in FIG. 2, the stationary components of three way valve assembly preferably include dowel bores 58 (FIG. 2), which are present to prevent the valve from being misassembled. In order to hold three way valve assembly together, it preferably includes a hollow clamp 46, as best shown in FIG. 5.

Referring now to FIGS. 2–5, various views are used to illustrate the preferred structure for the needle control valve assembly 14 of the present invention. As stated earlier, valve assembly 14 is held together by a hollow clamp 46 that includes a hollow bolt 73 threadably mated to a nut 74. In order to prevent interference between hollow clamp 46 and the fuel injector components positioned above and below valve assembly 14, the hollow clamp 46 is preferably positioned between a first plane 70 and a second plane 71. These planes are preferably coincident with first end surface 68 and a second end surface 69 of valve assembly 14, respectively. In the illustrated embodiment, nut 74 is located within upper seat component 43. Nevertheless, those skilled in the art will appreciate that the structure could be inverted such that nut 74 was located in lower seat component 45. In fact, this alternative structure may be desirable in relation to better facilitating the assembly of valve 14 to electrical actuator 16 (see FIG. 1).

In the preferred embodiment, the counter bore that receives nut 74 preferably has an inner diameter only slightly larger than the outer diameter of nut 74, in order to conserve space. As such, nut 74 preferably includes tool engagement surfaces 78 that allow a socket or other tightening tool to engage and rotate nut 74 to tighten the same on hollow bolt 73. In particular, nut 74 includes a threaded annular inner surface that separates a contact surface 76 from a face surface 77, which includes four tool engagement surfaces 78. Those skilled in the art will appreciate that the geometry of the tool engagement surfaces could take on a wide variety of forms without departing from the present invention. For instance, the face 77 of nut 74 could include two or more bores that could receive pegs from a socket or the like. As best shown in FIGS. 1 and 5, fluid passages 40 and 41 pass through respective U-shaped portions 80 formed as portions of hollow bolt 73. When valve 14 is assembled, upper seat component 43 and spacer 44 create an annular sealing land 81 that surrounds the central volume that holds valve member 42. In addition, when spacer 44 contacts lower seat component 45, another annular sealing land 82 is created that also surrounds a portion of valve member 42. Both sealing lands 81 and 82 are located within hollow clamp 46. It should also be noted that a substantial portion, greater than half, of the top and bottom surfaces of spacer 44 are removed to allow the clamping forces to be concentrated in the areas of sealing lands 81 and 82 as well as the outer wings shown in FIG. 4 in order to better inhibit leakage between the various fluid passageways that travel through valve assembly 14.

Those skilled in the art will appreciate that the end portions 79 of hollow bolt 73 will tend to move toward one another when nut 74 is tightened. In order to prevent distortion, upper seat component 43 is provided with a clamp support portion 49 with an outer diameter about equal to the inner diameter of hollow bolt 73. In this way, hollow bolt 73 is radially supported when nut 74 is tightened during the assembly procedure.

INDUSTRIAL APPLICABILITY

The present invention finds potential application in any valve made up of a plurality of body components containing fluid passages that can be at substantially different pressures. In other words, a valve assembly that includes sealing lands between body components in which relatively large pressure differentials exist leading to the possibility of fluid leakage between passageways to the detriment in the operation of the valve. In addition, the present invention preferably finds particular application in the case of high speed valves that are required to accommodate relatively low flow volumes and high pressure differentials, such as pressure control valves employed in fuel injection systems.

When fuel injector 10 is in operation, electro-hydraulic actuator 12 works in conjunction with direct control needle valve 11 to control both timing and quantity of each injection event. Each injection event is initialized by raising fuel pressure in high pressure source 18 to injection levels. In some systems, this is accomplished by maintaining a common rail at some desired pressure. Alternatively, source 18 can be a fuel pressurization chamber within a unit injector which is pressurized when a plunger is driven downward, which is usually accomplished with a cam or a hydraulic force. Because valve member 42 is biased downward to close low pressure seat 51, direct control needle valve 11 will stay in its downward closed position due to the high pressure force acting on closing hydraulic surface 33 of piston portion 32. Shortly before the timing at which the injection event is desired to start, electrical actuator 16 is preferably energized by supplying an excessive current to coil 60. Because the speed at which electrical actuator 16 operates is related to the current level supplied to coil 60, one preferably supplies the maximum available current, which can be substantially higher than an amount of current necessary to cause the armature to move against the action of the spring bias. When sufficient magnetic flux builds, armature 62 and valve member 42 are pulled upwards until the spherical valve surface of valve member 42 contacts upper or high pressure seat 50. When this occurs, needle control chamber 37 is fluidly connected to low pressure fuel reservoir 20 via low pressure passage 41. In order for direct control needle valve 11 to lift to its upward open position, fluid must be displaced from needle control chamber 37 toward low pressure reservoir 20. The rate at which direct control needle valve 11 opens is slowed by restricting this flow through cylindrical segment 48. This aids in allowing fuel injector 10 to produce some rate shaping. Shortly before the desired end of an injection event, current to electrical actuator 16 is reduced or terminated to a level that allows spring 67 to push armature 62 and valve member 42 downward until the lower spherical valve surface of valve member 42 comes in contact with low pressure seat 51. When this occurs, high pressure fluid originating in nozzle supply passage 24 flows through high pressure passage 40 past high pressure seat 50 and into needle control chamber 37. The rate at which pressure builds in needle control chamber 37 and hence the response time from when current is terminated until direct control needle valve 11 moves toward its closed position can be influenced by appropriately sizing cylindrical segment 47.

In order to produce fuel injectors 10 that behave consistently, the present invention preferably includes a structure for three way needle control valve assembly 14 that alleviates some of the problems that have plagued past valves. By including flow restrictions (cylindrical segments 47 and 48) away from valve seats 50 and 51, respectively fluid flow forces that can interfere with movement of the valve member 42 are reduced since the pressure differentials often associated with valves are moved away from the valve seats. Furthermore, by locating these flow restrictions in the valve lift spacer 44 (FIGS. 1–5), the flow restrictions can be more easily manufactured, and permits valve opening and closing pressure control to be set somewhat independently. This same strategy allows more consistency in performance among valves since their performance is desensitized from the flow areas across the respective seats of the valves which will likely be different from one valve to another due at least in part to the fact that each component has geometrical tolerances that render them realistically manufacturable. Because the cylindrical segments 47 and 48 formed in the valve lift spacer can be made with great consistency, the behavior of the respective valves can be made more consistent.

Another feature of the valve assembly 14 of the present invention that can provide for more consistent performance includes the use of a valve lift spacer 44 as a category part. In other words, in order for consistency to be maintained, the valve travel distance from one valve to another should be made as consistent as possible. In the case of the present valve, this is accomplished by choosing a valve lift spacer for each individual valve with a thickness that results in a relatively uniform travel distance from one valve to another. In other words, each valve should have relatively uniform travel distances, but this is accomplished by employing valve lift spacers of a variety of thicknesses in each of the different valves. In the case of the present invention, the valve travel distance is preferably on the order of about 30 microns, or between 25 and 35 microns. In any event, the strategy of the present invention can be employed to reliably produce valves with consistent lifts less than about 50 microns. This is accomplished by grouping valve lift spacers in a plurality of different thickness groups. Preferably, each of these groups contain valve lift spacers of a specific predetermined thickness plus or minus about three microns.

Another strategy employed by the present invention in order to improve response time includes defining the needle control chamber, at least in part with volume reducing features. Ordinarily, this will be accomplished by paying attention to machining the various components that make up needle control chamber 37 in order to reduce its volume. By reducing its volume, it can respond to pressure changes more quickly. For instance, in the present invention, this strategy is employed, for example, by making the vertical portion of needle control chamber 37 only extend a portion of the way into valve lift spacer 44. Thus, the top surface of this segment could be considered a volume reducing surface feature.

Those skilled in the art will appreciate that leakage through the valve, especially during fuel injection events, is generally undesirable. Fluid leakage is generally reduced by relying upon a three way valve as in the present invention instead of a two way valve that relies upon leakage to produce its pressure changes as in some other known needle control strategies. Nevertheless, the present invention is also applicable to two way needle control valve assemblies. Those skilled in the art will appreciate that the pressure differentials in the three way valve can be extremely high during a fuel injection event. This pressure acts to push the upper seat component away from the lower seat component, and fluid will tend to migrate in the sealing land areas especially on the upper and lower surfaces of the valve lift spacer 44. By locating the low pressure passage away from this area, these embodiments may exhibit better performance with regard to reducing leakage. Reducing leakage can generally improve the reliability and predictability of the fuel injection quantity. Since a fuel injection quantity is often defined by the control valve on time duration, any fuel that leaks past the valve can necessarily reduce the amount of fuel actually injected below a predicted amount.

Valve 14 is preferably assembled by first inserting valve member 42 into lower seat component 45. A nominal valve lift spacer having a nominal known thickness is then placed atop lower seat component 45. Next, the upper seat component is placed atop the nominal valve lift spacer. Next, the valve travel distance is measured. Using this information, a valve lift spacer having some appropriate thickness can be determined in order to produce a valve travel distance within predetermined tolerances. The valve is then disassembled and the chosen valve lift spacer is inserted in place of the nominal valve lift spacer. The hollow bolt 73 is inserted from underneath through lower seat component 45 until upper portion 79 is adjacent clamp support portion 49 of upper seat component 43. Nut 74 is then threadably engaged to hollow bolt 73. Before the nut 74 is tightened completely, the upper and lower valve seats 50 and 51 are made concentric, such as via a vibration procedure. Finally, nut 74 is tightened to its predetermined torque by engaging a tightening tool, such as a socket, with the tool engagement surfaces 78 located on the face 77 of nut 74.

Fluid leakage between the various passageways and volumes in valve assembly 14 is substantially reduced by locating the annular sealing lands 81 and 82 within hollow clamp 46. This concentrates the clamping load on the sealing lands where it is needed most, rather than relying upon a clamping load produced by fasteners positioned in the outer periphery of the valve assembly. In addition, by removing surface material from the top and bottom surfaces of valve lift spacer 44 so that the overall sealing land is less than half of the area of the parameter of valve lift spacer 44, the clamping loads can also be concentrated in the outer wings of the sealing lands (see FIG. 4). These outer wings adjacent annular sealing lands 81 and 82 accommodate flow passages, around which leakage could also occur. Finally, by locating the fluid passages 40 and 41 through the U-shaped portions 80 of hollow bolt 73, potential fuel leakage is further limited.

Those skilled in the art will appreciate that various modifications could be made to the illustrated embodiment without departing from the intended scope of the present invention. The present invention is applicable to any valve that includes body components that must be clamped together to avoid leakage in the sealing land area where the body components contact one another. Thus, those skilled in the art will appreciate the other aspects, objects and advantages of this invention can be obtained from a study of the drawings, the disclosure and the appended claims.

What is claimed is:

1. A valve assembly comprising:

a valve body including a plurality of body components;

a hollow clamp clamped to, and at least partially surrounded by, said plurality of body components;

a valve member at least partially positioned in said hollow clamp;

said valve body is bounded by a first plane and a second plane that is parallel to said first plane; and said hollow clamp being located between said first plane and said second plane.

2. A valve assembly comprising:

a valve body including a plurality of body components;

a hollow clamp clamped to, and at least partially surrounded by, said plurality of body components;

a valve member at least partially positioned in said hollow clamp said hollow clamp includes a hollow bolt threadably attached to a nut;

said nut includes a contact surface separated from a face surface by an annular outer surface; and said face surface includes at least one tightening tool engagement surface.

3. A valve assembly comprising:

a valve body including a plurality of body components;

a hollow clamp clamped to, and at least partially surrounded by, said plurality of body components;

a valve member at least partially positioned in said hollow clamp said hollow clamp includes a hollow bolt threadably attached to a nut;

one of said plurality of body components includes a clamp support portion with an outer diameter; and a portion of said hollow bolt contacting said clamp support portion having an inner diameter that is about equal to said outer diameter.

4. A valve assembly comprising:

a valve body including a plurality of body components;

a hollow clamp clamped to, and at least partially surrounded by, said plurality of body components;

a valve member at least partially positioned in said hollow clamp; said plurality of body components includes a first seat component separated from a second seat component by a spacer; and said valve member being trapped to move between a first seat on said first seat component and a second seat on said second seat component.

5. A valve assembly comprising:

a valve body including a plurality of body components;

a hollow clamp clamped to, and at least partially surrounded by, said plurality of body components;

a valve member at least partially positioned in said hollow clamp;

said plurality of body components includes a spacer with a planar surface in contact with a seat component;

said valve body including a plurality of fluid passages that pass through said planar surface; and an area of said planar surface being less than half an area inside a perimeter of said spacer.

6. A valve assembly comprising:

a valve body including a plurality of body components;

a hollow clamp clamped to said plurality of body components; and a valve member at least partially positioned in said hollow clamp; and said clamp includes a U-shaped portion partially surrounding a portion of said valve body having a fluid passage disposed therein.

7. The valve assembly of claim 6 wherein said plurality of body components includes an annular sealing land located within said hollow clamp.

8. A fuel injector comprising:

a direct control needle valve that includes a needle portion for opening and closing at least one nozzle outlet;

a needle control valve assembly that includes a plurality of valve body components clamped together with a hollow clamp, and including a needle control valve member that is different from the needle portion of the direct control needle valve and is at least partially positioned in said hollow clamp; and the needle control valve assembly being positioned in an injector body.

9. The fuel injector of claim 8 wherein the plurality of valve body components includes a first seat component separated from a second seat component by a spacer; and said needle control valve member being trapped to move between a first seat on said first seat component and a second seat on said second seat component.

10. The fuel injector of claim 8 including a needle valve member with a closing hydraulic surface exposed to fluid pressure in a needle control chamber; and said needle control valve assembly being fluidly coupled to said needle control chamber.

11. The fuel injector of claim 10 wherein the plurality of valve body components include an annular sealing land located within said hollow clamp.

12. The fuel injector of claim 11 wherein one of said plurality of valve body components includes a clamp support portion with an outer diameter; and a portion of said hollow clamp contacting said clamp support portion having an inner diameter that is about equal to said outer diameter.

13. A fuel injector comprising:

a needle control valve assembly that includes a plurality of valve body components clamped together with a hollow clamp, and including a needle control valve member at least partially positioned in said hollow clamp;

said hollow clamp includes a hollow bolt threadably attached to a nut; and said hollow bolt includes a U-shaped portion partially surrounding a portion of a fluid passage disposed in the plurality of valve body components.

14. A fuel injector comprising:

a direct control needle valve that includes a needle portion for opening and closing at least one nozzle outlet;

a needle control valve assembly that includes a plurality of valve body components clamped together with a hollow clamp, and including a needle control valve member that is different from the needle portion of the direct control needle valve and is at least partially positioned in said hollow clamp;

the plurality of valve body components are bounded by a pair of parallel planes; and said hollow clamp being positioned between said parallel planes.

15. A method of reducing leakage in a valve assembly, comprising the steps of:

clamping a plurality of valve body components together with a hollow clamp that is at least partially surrounded by the plurality of valve body components;

positioning a valve member at least partially within the hollow clamp; and locating an annular sealing land of the plurality of valve body components within the hollow clamp.

16. The method of claim 15 including a step of supporting the hollow clamp at least in part by sizing a clamp support portion with an outer diameter about equal to an inner diameter of a contact portion of the hollow clamp.

17. A method of reducing leakage in a valve assembly, comprising the steps of:

clamping a plurality of valve body components together with a hollow clamp;

positioning a valve member at least partially within the hollow clamp; and locating an annular sealing land of the plurality of valve body components within the hollow clamp; and routing a fluid passage through a U-shaped portion of the hollow clamp.

18. The method of claim 15 wherein said clamping step includes a step of engaging a tool engagement surface on a face of a nut with a tightening tool.

* * * * *